US006658908B1

(12) United States Patent
Ghiran et al.

(10) Patent No.: US 6,658,908 B1
(45) Date of Patent: Dec. 9, 2003

(54) PUNCH FOR PIERCING AND SEALING HYDROFORMED PARTS

(75) Inventors: Mircea M Ghiran, Lake Orion, MI (US); Terry Andrew Kent, East China, MI (US); Benjamin D Kaufman, Harrison Township, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/223,753

(22) Filed: Aug. 20, 2002

(51) Int. Cl.[7] ..... B21D 28/28
(52) U.S. Cl. ..... 72/55; 83/53
(58) Field of Search ..... 72/55; 83/53

(56) References Cited

U.S. PATENT DOCUMENTS 5,398,533 A 3/1995 Shimanovski et al. ..... 72/55
5,666,840 A * 9/1997 Shah et al. ..... 72/55
5,765,420 A * 6/1998 Schaefer ..... 72/55
5,799,524 A * 9/1998 Schafer et al. ..... 72/55
5,941,112 A 8/1999 Chiran et al. ..... 72/55
5,974,846 A * 11/1999 Ash ..... 72/55
6,305,201 B1 * 10/2001 Ghiran et al. ..... 72/55

* cited by examiner

*Primary Examiner*—David B. Jones
(74) *Attorney, Agent, or Firm*—Charles E. Leahy

(57) ABSTRACT

A punch for piercing and sealing hydroforming parts has a roll forming surface that produces an internal rolled edge portion in a formed part immediately following the punch piercing the part wherein the rolled edge portion acts to effect a tight high pressure seal between the part and the punch as the punch continues to form a required hole in the part. The roll-forming surface extends either partially or completely about the punch in determining the extent of the rolled edge portion in the part that it produces and is located between an end portion that effects the piercing operation and a larger finishing portion that completes the formation of the required hole.

7 Claims, 10 Drawing Sheets

PUNCH FOR PIERCING AND SEALING HYDROFORMED PARTS

TECHNICAL FIELD

This invention relates to the punches used to pierce holes in hydroformed parts and more particularly to the sealing of the punches with respect to the hydroformed parts.

BACKGROUND OF THE INVENTION

As is well known in the art of hydroforming parts from a tubular metal part, the hydroforming pressure used to form the part can also be utilized to assist a punch in piercing the part to produce a required hole therein during the hydroforming process. Thus eliminating the need for a secondary operation such as laser cutting to form the hole in an internally unsupported region of the part. For example, hydroforming apparatus including such a punch is disclosed in U.S. Pat. No. 5,398,533 assigned to the assignee of this invention.

Another example of piercing a hydroformed part is shown and labeled as "Prior Art" in FIG. 1 of the accompanying drawings and is included to help illustrate a problem in the piercing phase of the hydroforming process that can result from using current state of the art punches. Referring to FIG. 1, the piercing operation is performed following completion of the hydroforming of a hollow metal part 10 in a die cavity 12 formed by dies 14 and 16 and while the formed part remains in intimate contact with the surface of the die cavity and while the hydroforming liquid fluid 18 in the part remains at the high pressure required for forming the part. In the piercing operation, a punch 20 of conventional cylindrical configuration whose piercing end is initially held in a position so as to form a continuation of the die cavity surface is then forced to pierce the formed part as shown to produce a hole required in the part. In this example, the required hole has a round or circular shape and the punch accordingly has a right-circular cylindrical surface.

When the punch 20 is forcibly extended for piercing, the forming pressure in the part supports the formed part about the periphery of the punch allowing the piercing or shearing action of the punch to occur. And the punch shears a slug 22 in forming the required hole in the part wherein the slug falls as a loose piece and lays inside the formed part for later removal.

However, when the punch pierces and enters the formed part, it has been found that considerable leakage can occur past the punch causing the forming pressure in the part to fall to the point where it fails to adequately support the part internally for the piercing action by the punch. When this occurs, the part can collapse inwardly in the region being pierced resulting in a undesired misshaped part at the end of its processing in the hydroforming die cavity. This is shown with phantom lines in FIG. 1. Moreover, in the case where several holes are to be pierced in the formed part in similar manner with other like conventional punches, the potential leakage problem increases proportionally and there is even more likelihood of ending up with misshaped parts.

Punches of various sizes and shapes are used to produce the holes required in hydroformed parts. With one of the main reasons for the holes being to provide access for tooling such as welding tips and wherein it may be necessary for the welding tips or other tooling to enter at an angle. Attempts have been made at solving the leakage problem with a punch configuration that extrudes a substantial portion of the formed part inwardly along the side of the punch to thereby provide improved sealing. Wherein such metal extrusion can be considerably longer and thus deeper than the extent of the extruded portion 24 shown in FIG. 1 that typically occurs without such a leakage solving punch modification. And the extent to which such extrusion is required to effect the necessary sealing can require a long deep extrusion into the formed part that is not acceptable such as in the case where it would create an obstruction to the required entry of tooling.

SUMMARY OF THE INVENTION

The present invention solves the above leakage problem in a very simple manner with a new and improved cost-effective punch configuration. Wherein during the hole forming operation, the punch configuration rolls over an annular edge portion of the formed part that defines the hole with the resulting rolled edge portion forcing a tight high-pressure seal between the part and the punch. And depending on the particular hole requirements and the sealing pressure capacity required to prevent leakage, the rolled edge portion of the formed part is formed by the punch configuration so as to extend only partially or completely about the punch in order to effectively prevent high pressure leakage and thereby avoid collapse of the part during the hole forming operation.

In accordance with the present invention and for the piercing, for example, of a required round hole, the punch is provided with three distinctly different portions comprising (1) a piercing end portion at its piercing end having either a partial or completely circular cylindrical surface with a radius less than that of the hole required; (2) a hole-finishing portion having a completely circular cylindrical surface that is concentric with the piercing end portion and has a radius sized to produce the size of the hole required; and (3) a roll-forming portion joining the piercing end portion with the hole-finishing portion. The roll-forming portion has either (1) an acutely angled surface or (2) a rounded or convex surfaces and depending on the sealing that is required in a particular application of the punch according to the present invention, these surfaces extend either partially or completely about the periphery of the punch between the piercing end portion of the punch and the hole-finishing portion of the punch.

Immediately following piercing of the formed part by the piercing end portion and as the punch continues to be advanced into the part, the end portion then pilots the pierced region of the part onto the roll-forming surface which then forces the wall of the part about the perimeter of the punch to extrude and gradually roll-form a rolled edge portion in the part extending either partially or completely about the punch prior to the hole-finishing portion of the punch entering the part to complete the formation of the required hole.

The rolled edge portion in the part, whether extending partially or completely about the punch as described above, forces an extremely tight fit between the periphery of the punch and the formed part as the punch extends into the part. Resulting in a metal-to-metal seal between the formed part and punch of very high pressure sealing capacity that is immediately formed following the piercing operation and continues during completion of the hole forming process such that the high hydroforming pressure is maintained throughout the hole forming operation to prevent collapse of the part. This is quite advantageous in that numerous holes and of possibly various sizes and shapes can be pierced in a formed part with punches according to the present invention without causing any collapse or misshaping the part since the hydroforming pressure is maintained regardless of whether only one hole is pierced or many holes are pierced in the part.

Moreover, the amount of extrusion of metal into the interior of the part in the piercing of the hole can be made relatively small as compared with the extent of the seal effecting extrusions produced with prior known punches in an attempt to provide the required high pressure sealing. As a result, there is less likelihood for obstruction to the entry of a tool at an angle. With this advantage being most pronounced where the rolled edge portion needs to extend only partially about the punch in order to obtain the required high pressure sealing capacity. Thereby leaving an unrolled sidewall portion of the hole that presents no substantial obstruction.

Furthermore, the present invention can be quite useful in the ongoing development of certain metal working functions that can be employed in the hydroforming process. For example, in the hydrotrimming and hydroshearing of parts in the hydroforming process such as with the method and apparatus disclosed in U.S. Pat. No. 5,941,112 assigned to the assignee of this invention. Wherein the present invention in solving the leakage problem enables the maintenance of the very high hydroforming pressures required for the continuing development of such hydrotrimming and hydroshearing in the hydroforming process.

It will therefore be appreciated that the punch according to the present invention provides for piercing a hole in a hydroformed part during the hydroforming process while also performing a roll forming operation on the part that acts to prevent leakage past the punch that might otherwise occur and result in collapse of the part during the piercing operation. Wherein the roll forming action on the wall of the part may extend either partially or completely about the punch as the punch enters the part to thereby provide a very tight, high pressure seal as required between the part and the punch during the hole forming operation. And wherein the punch has an acutely angled surface or a rounded or convex surface for effecting this roll forming action on the wall of the part in producing the very tight, high pressure seal between the part and the punch during the hole forming operation.

These and other aspects of the present invention will become more apparent from the following description and accompanying drawings.

DESCRIPTION OF EXEMPLARY EMBODIMENTS

Figure 1:
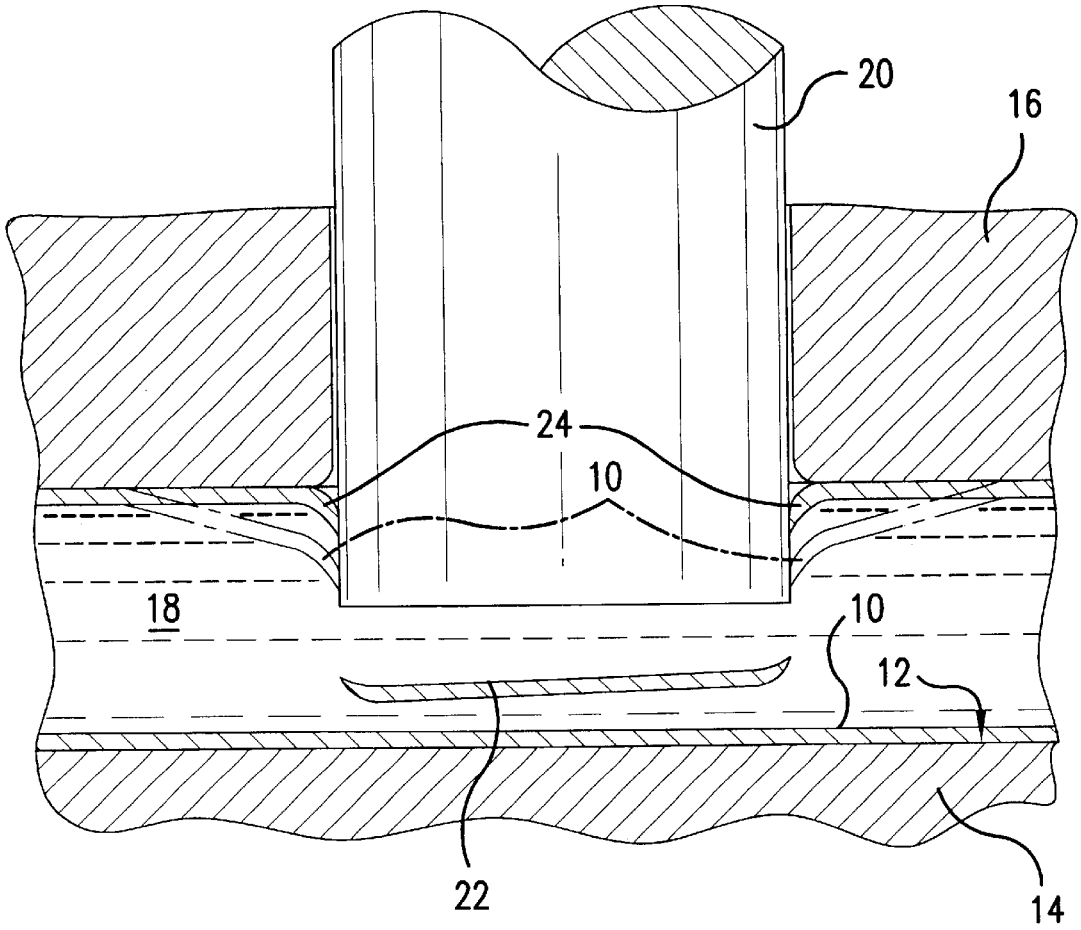
FIG. 1 PRIOR ART
FIG. 1 is a partial view partially in section of hydroforming apparatus employing a conventional PRIOR ART punch.
Figure 2:
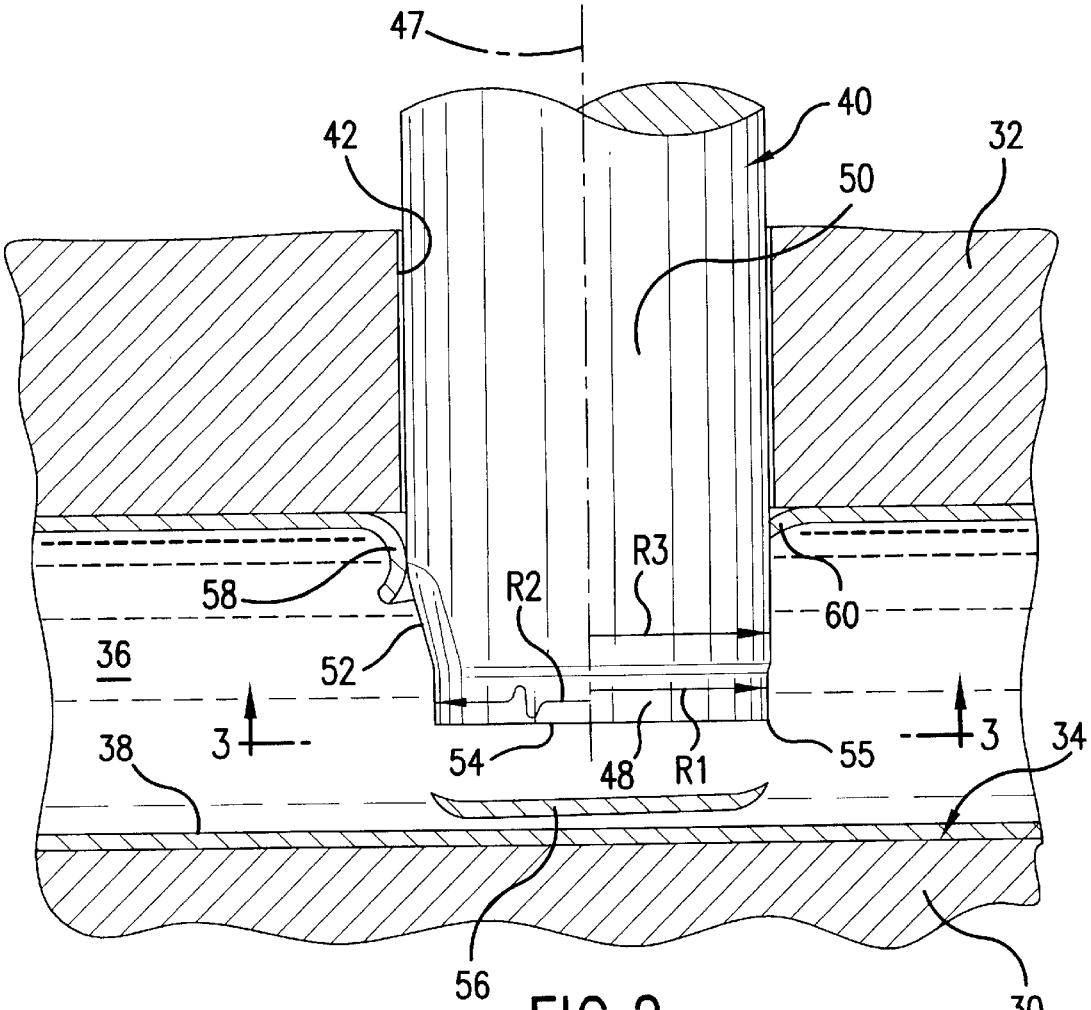
FIG. 2 is a partial view partially in section of hydroforming apparatus employing an exemplary embodiment of the punch according to the present invention.

Referring to FIG. 2, there is shown a portion of conventional hydroforming apparatus relevant to the present invention comprising a lower die 30 and an upper die 32. Wherein these dies co-operatively form a die cavity 34 in which a tubular part is hydroformed to the die cavity surface. And wherein hydroforming of the tubular metal part is accomplished in a conventional well-known hydroforming manner by the delivery of a suitable hydraulic fluid 36 at a desired pressure to the interior of the tubular part resulting in a formed part 38 as shown.

Figure 4:
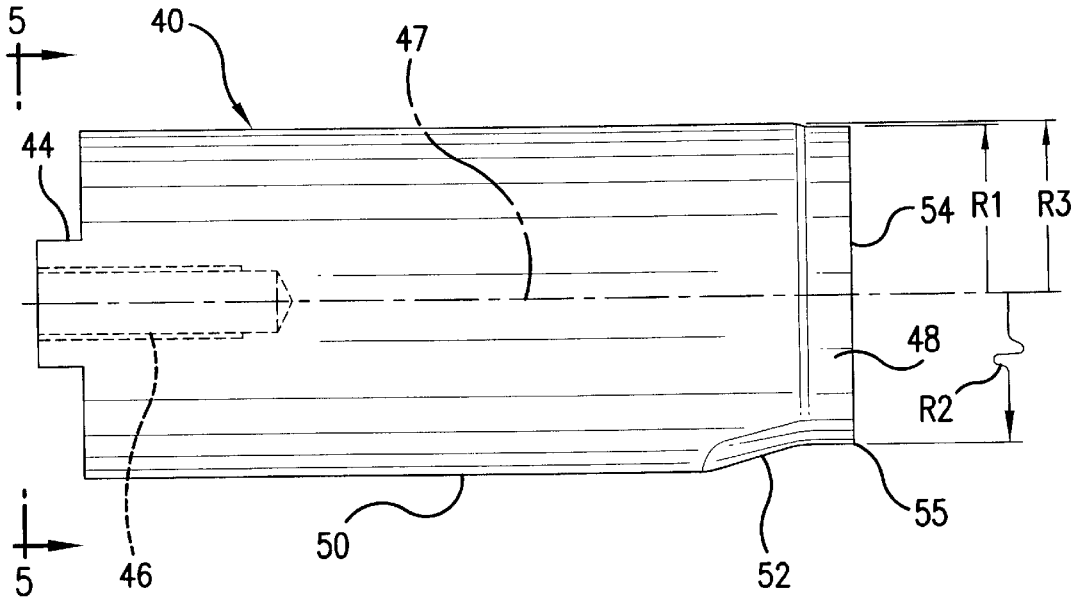
FIG. 4 is a full side view of the punch in FIG. 2.
Figure 5:
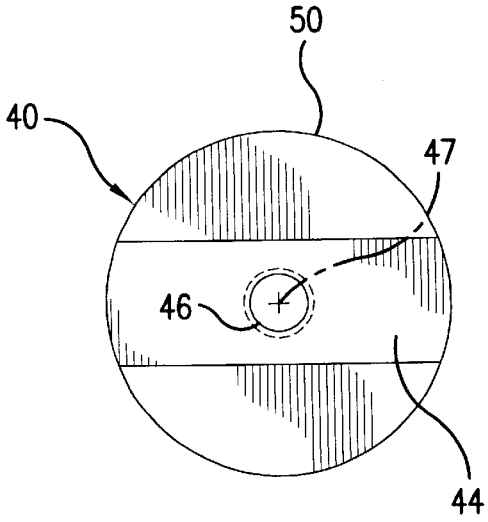
FIG. 5 is a view taken along the line 5—5 in FIG. 4 when looking in the direction of the arrows.
Figure 6:
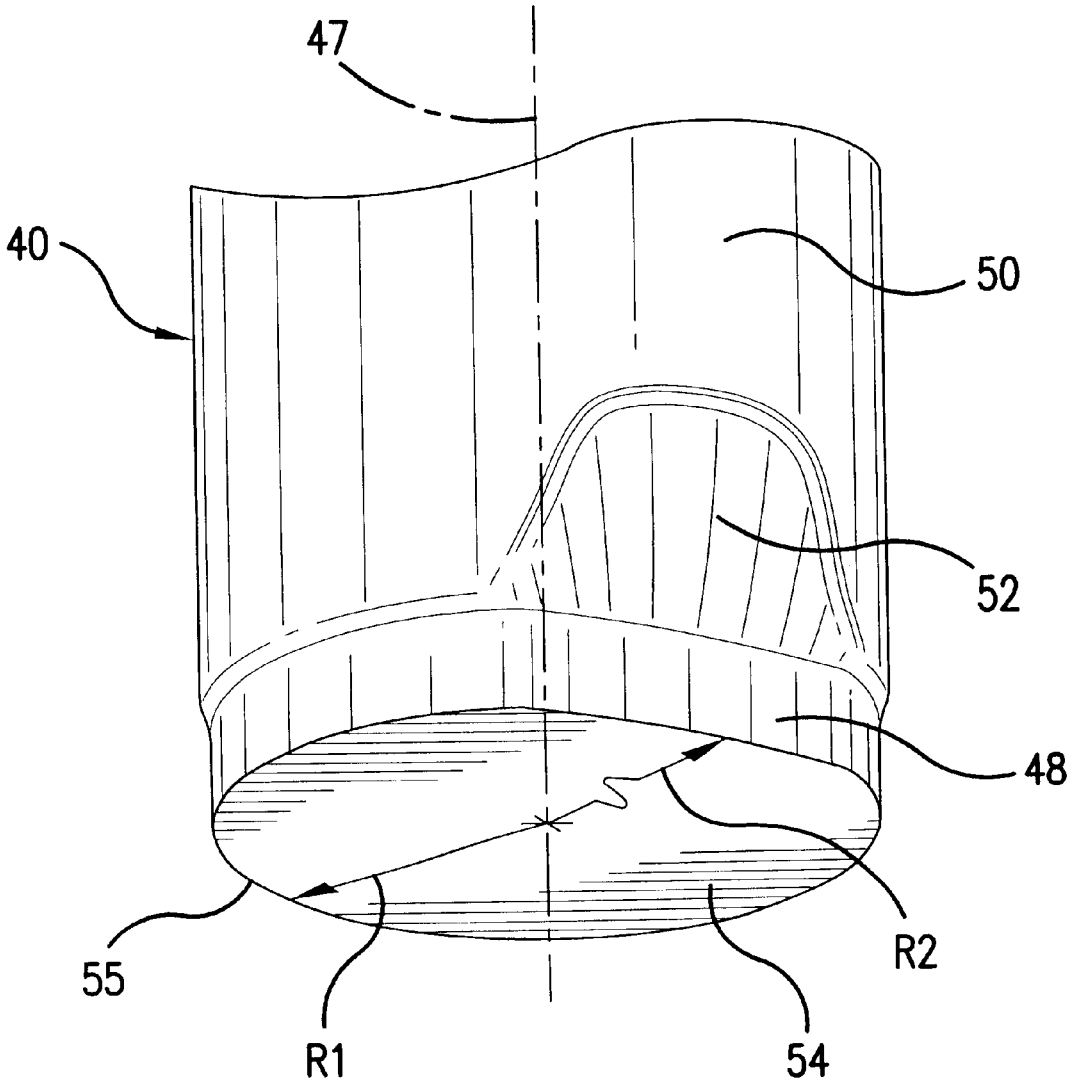
FIG. 6 is a three-dimension view of the working end of the punch in FIG. 2.

For the piercing of a hole required in the formed part, there is provided a punch 40 in accordance with the present invention that is made of suitable tool steel and is mounted for sliding movement in a bore 42 in the upper die 32 that extends to this die's cavity forming surface. With the punch 40 adapted at its outer end for connection with a suitable punch-operating device such as a hydraulic cylinder by means of a tongue 44 and a centrally located threaded hole 46 in the tongue. See FIGS. 4 and 5. And it will be understood that the punch operating device is operated in a conventional manner for the hole forming operation during the hydroforming process and possibly through a cam mechanism as disclosed in the aforementioned U.S. Pat. No. 5,398,533.

Referring to FIGS. 2, 3, 4 and 6, the punch 40 is formed about a centerline 47 with three distinctive and concentric hole forming portions comprising (1) a piercing end portion 48 at the piercing end of the punch that also provides a piloting action, (2) a hole-finishing portion 50 that finishes the formation of the hole, and (3) a roll-forming portion 52 joining the end portion 48 with the finishing portion 50.

The hole required in the formed part is in a flat wall portion of the part and has a circular or round shape. And for forming such, the piercing end portion 48 of the punch has a cylindrical surface extending about the punch comprising a right-circular cylindrical portion with a radius R1 slightly less than that of the required hole and a non-circular convex cylindrical portion with a varying radius R2 less than the radius R1. In addition, the piercing end portion 48 has a flat end face 54 perpendicular to the centerline 47, a sharp cutting edge 55 extending completely about the end face 54, and an axial or length-wise dimension at least slightly greater than the wall thickness of the formed part.

The hole-finishing portion 50 of the punch has a right-circular cylindrical surface that extends completely about the punch and has a radius R3 sized so as to produce the size of the hole required. The hole-finishing portion 50 is also that part of the punch that is received in the bore 42 in the upper die and this bore is sized accordingly to precisely guide the punch for the hole forming operation.

The roll-forming portion 52 joining the piercing end portion 48 with the hole-finishing portion 50 is formed by an angled or tapered surface that angles radially outward at a small acute angle (e.g. fifteen degrees) from the axially inward terminus of the end portion 48 to the hole-finishing portion 50. In this embodiment of the punch, the angled roll-forming surface 52 extends only partially about the periphery of the punch and gradually varies in extent from a maximum axial dimension to a zero dimension in opposite annular directions from the maximum dimension in blending with the hole-finishing portion 50. See FIGS. 2, 3, 4 and 6.

In the piercing of a hole in the formed part, the punch 40 is initially held in a conventional manner against the part during the hydroforming of the part in the die cavity. Following the hydroforming of the part and while the hydroforming pressure is maintained in the part, the punch is then advanced to forcibly press the end face 54 of the punch against the outer side of a wall region of the part while the hydroforming pressure supports the inner side of this wall region. With continuing forced advancement of the punch, the cutting edge 55 then shears a slug 56 from the wall that drops into the formed part and wherein the size and shape of the slug corresponds to that of the punch end face 54. Then as the punch continues to be advanced under force into the wall opening thus created, the end portion 48 then pilots a wall portion of the opening in the part onto the angled roll-forming surface 52 which immediately starts forcing the corresponding portion of the wall of the part that it engages to extrude inward of the part while producing tension in the outer side of this wall portion because of the friction there between. Simultaneous therewith, a portion of the hole-finishing portion 50 diagonally opposite the surface 52 also enters the pierced opening and effects an extruding operation on the corresponding portion of the wall of the part that it engages. With the extent of such extrusion by the hole-finishing portion 50 being determined by the difference in the radiuses R1 and R3 and being made sufficient to effect sealing between the punch and the part in conjunction with the roll forming operation of the punch as will now be described.

Figure 3:
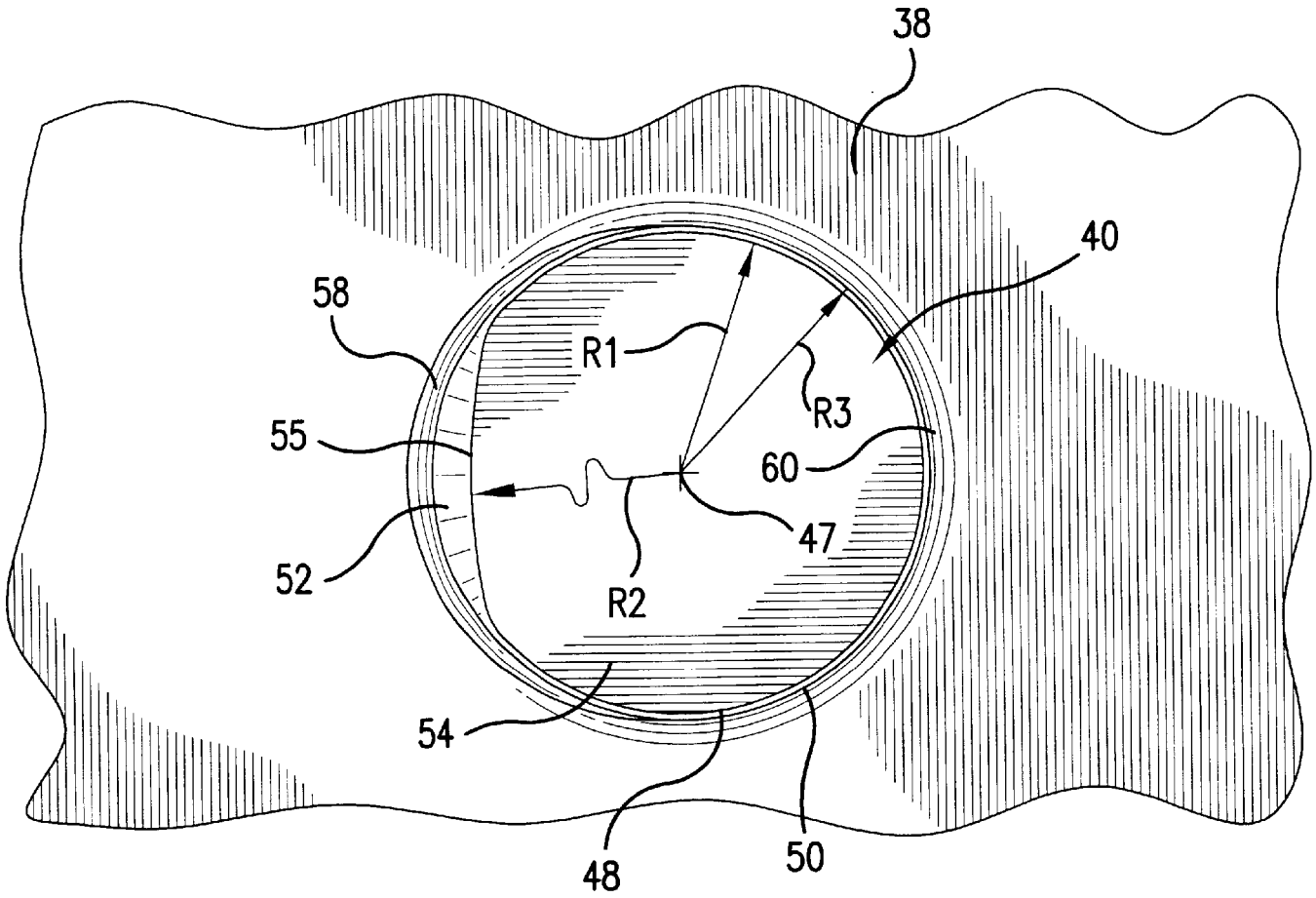
FIG. 3 is a view taken along the line 3—3 in FIG. 2 when looking in the direction of the arrows.

As the roll-forming portion 52 progresses into the pierced opening in the part, its angled surface causes the wall portion that it frictionally engages to bend in a roll-forming manner thereby forming a rolled or curled edge portion 58 in the formed part until the adjoining hole-forming portion 50 finally reaches the opening and thereafter operates on the rolled-edge portion 58 to smoothly complete the formation of the opening in the part to the required hole size. And wherein there remains a slightly extruded but unrolled edge portion 60 that together with the rolled edge portion 58 defines the finished hole as shown in FIGS. 2 and 3.

The rolled edge portion 58, though extending only partially about the punch, forces a very tight, high-pressure, metal-to-metal seal all about and between the pierced region of the part and the punch immediately at the end of the piercing operation and as the punch continues to enter the part and complete the formation of the rolled edge portion 58 with the angled roll-forming surface 52 and finally the required hole with the hole-finishing portion 50. Such that no significant leakage occurs and as a result the hydroforming pressure is maintained in the part to prevent collapse of the part during the hole forming operation to the completion of the hydroforming process.

In practicing the invention, the peripheral extent of the angled roll-forming surface 52 and amount of extrusion by the hole-finishing portion 50 is varied to meet the sealing requirements of a particular hole forming operation. And this is particularly advantageous in that the amount of metal working required in the rolling and extruding operations by the punch can be minimized by varying the peripheral extent of the angled roll-forming surface 52 and the difference between radiuses R1 and R3 so that there is just enough peripheral extent of the rolled edge portion 58 and just enough extrusion that takes place in order to satisfactorily meet the sealing requirement in a particular hole forming operation. Moreover, since the rolled edge portion 58 extends only partially about the finished hole, there is substantially no obstruction to the angled entry of a tool presented by the sidewall portion 60 of the hole that has not been rolled.

With such sealing thus very effectively accomplished by the punch 40 wherein no significant leakage is allowed to occur, it will be appreciated that this allows numerous holes and of possibly various sizes and shapes to be pierced in like manner in the same part all during the hydroforming process. Without causing any misshaping of the part since the hydroforming pressure is maintained regardless of whether only one hole is pierced or several holes are pierced in the part.

Figure 7:
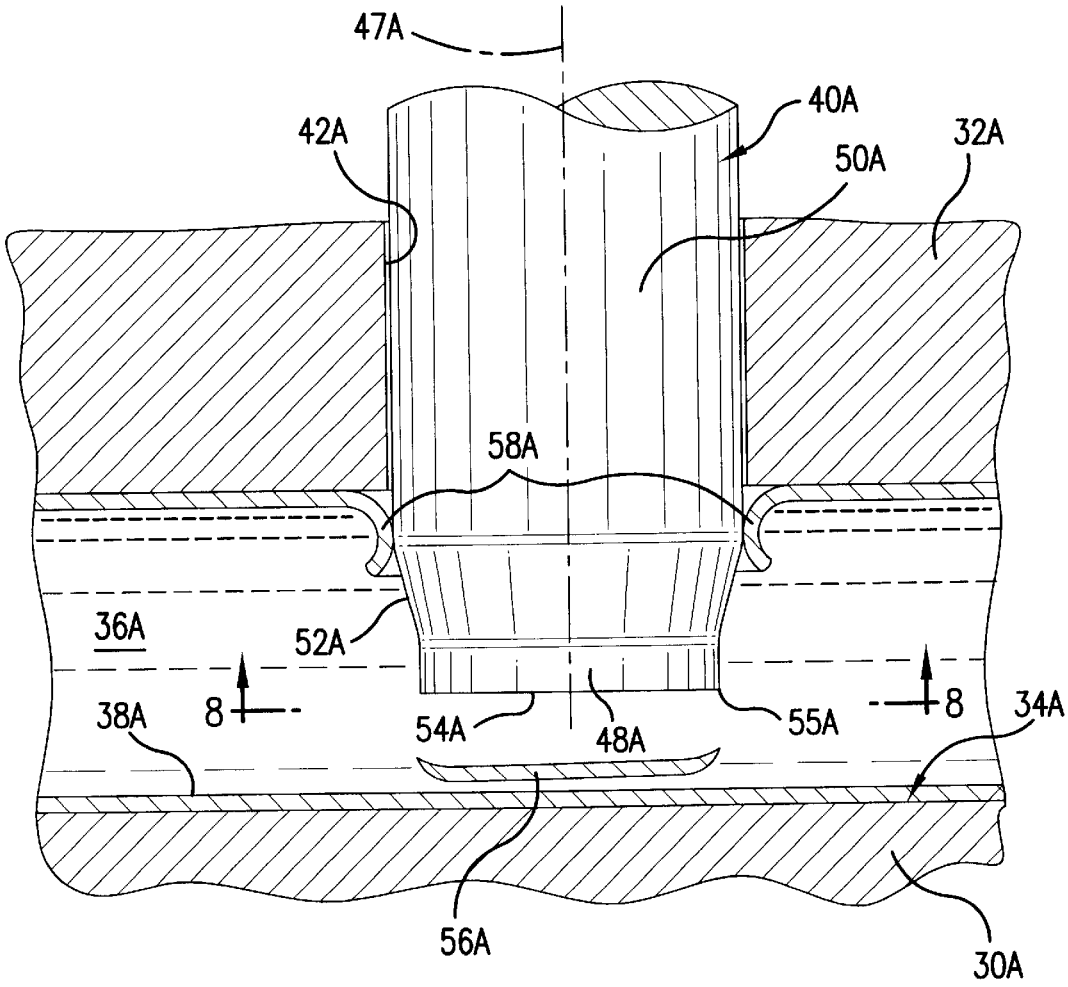
FIG. 7 is a view similar to FIG. 2 but showing another embodiment of the punch according to the present invention.
Figure 8:
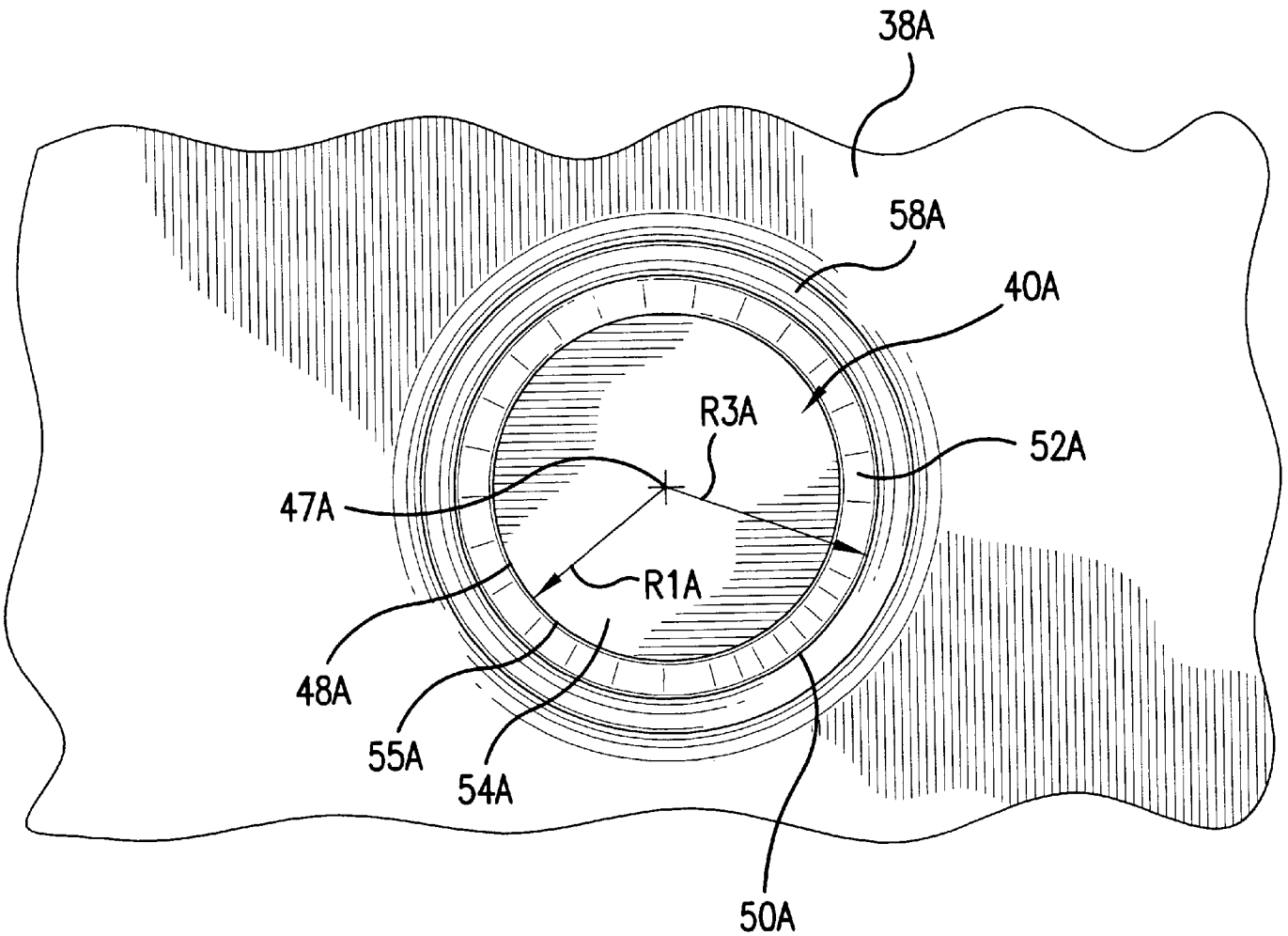
FIG. 8 is a view taken along the line 8—8 in FIG. 7 when looking in the direction of the arrows.
Figure 9:
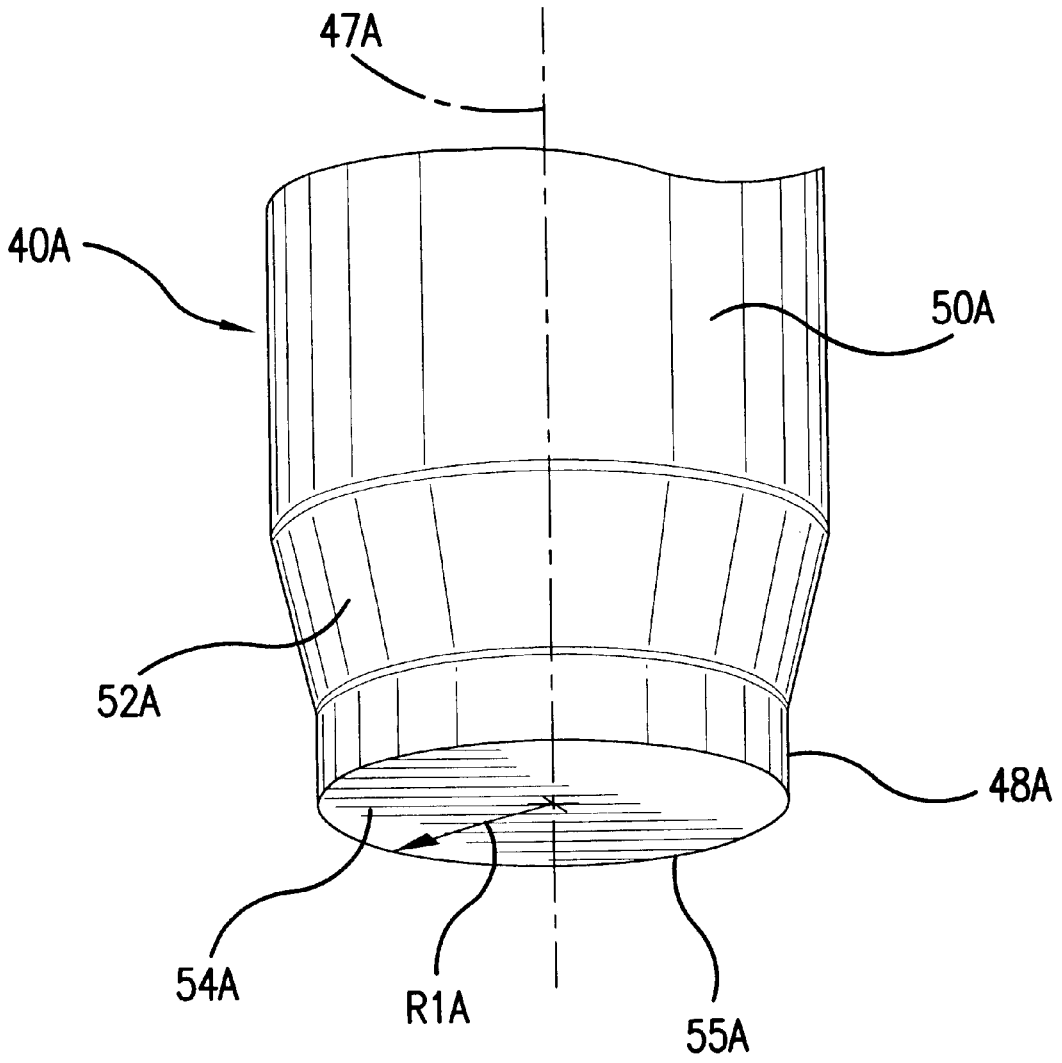
FIG. 9 is a three-dimensional view of the working end of the punch in FIG. 7.

In hole forming operations where the sealing requirements are significantly higher than those that can be met by the varying the partial peripheral extent of the angled roll-forming surface 52 of the punch 40, another exemplary embodiment of the punch according to the present invention can be employed as shown in FIGS. 7–9. And wherein it will be understood that the same numbers and the letter "R" used in FIGS. 2–6 are used in FIGS. 7–9 to identify corresponding parts and features but with the suffix "A" added.

Referring now to FIGS. 7–9 and to meet higher sealing requirements such as can result from the need to use significantly higher forming pressures to either form the part 38A and/or support the part for piercing, the piercing end portion 48A of the punch 40A is now provided with respect to its centerline 47A with a completely circular cylindrical surface having a radius R1A that is considerably smaller than the radius R3A of the hole-finishing portion 50A. And the angled roll-forming surface 52A is now extended completely about the periphery of the punch and thus forms a conically profiled section between the piercing end portion 48A and the hole-finishing portion 50A.

As a result of these modifications and following piercing by the end portion 48A, the angled roll-forming surface 52A forces all of the immediately surrounding wall of the part 38A to extrude and bend or roll prior to the finishing portion 50A of the punch entering the opening in the part. This rolling operation by the roll-forming surface 52A produces a rolled edge portion 58A in the part that extends completely about the punch and serves to effect an extremely tight metal-to-metal seal between the punch 40A and the formed part 38A that is capable of sealing very high hydroforming pressures.

Figure 10:
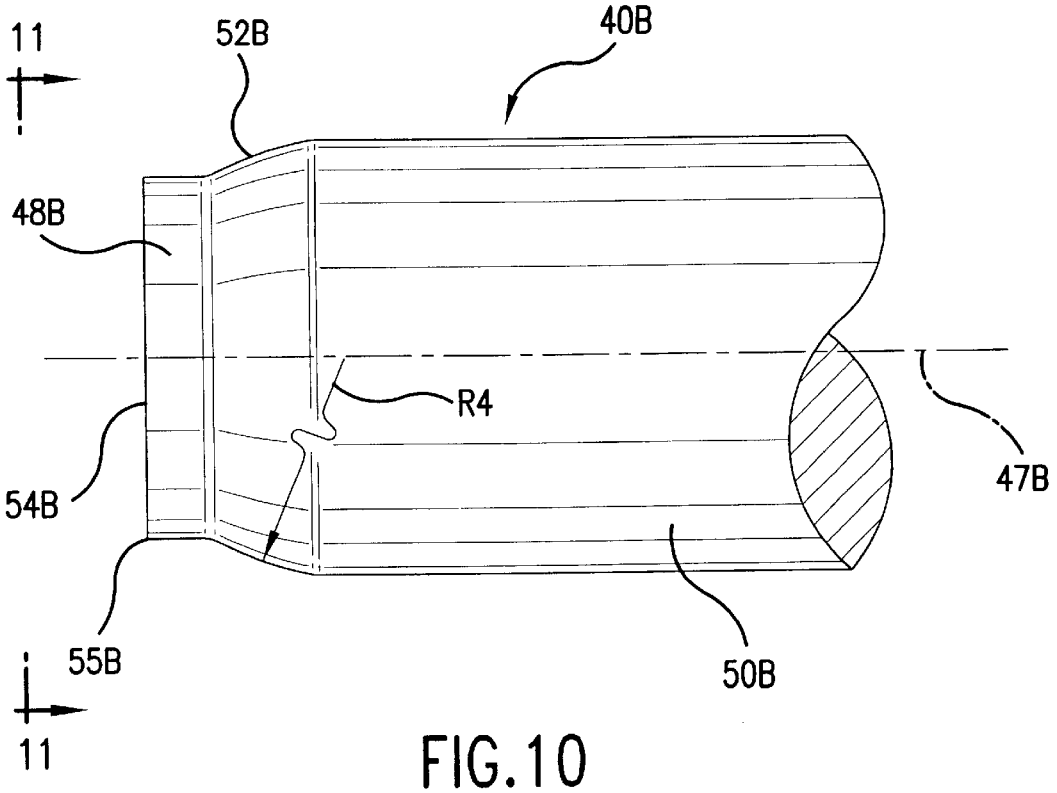
FIG. 10 is a partial side view of another embodiment of the punch according to the present invention.
Figure 11:
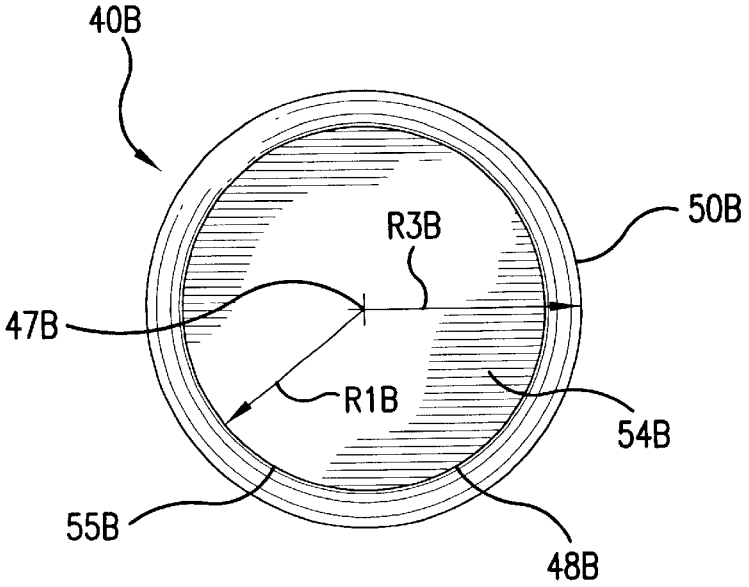
FIG. 11 is a view taken along the lines 11—11 in FIG. 10 when looking in the direction of the arrows.
Figure 12:
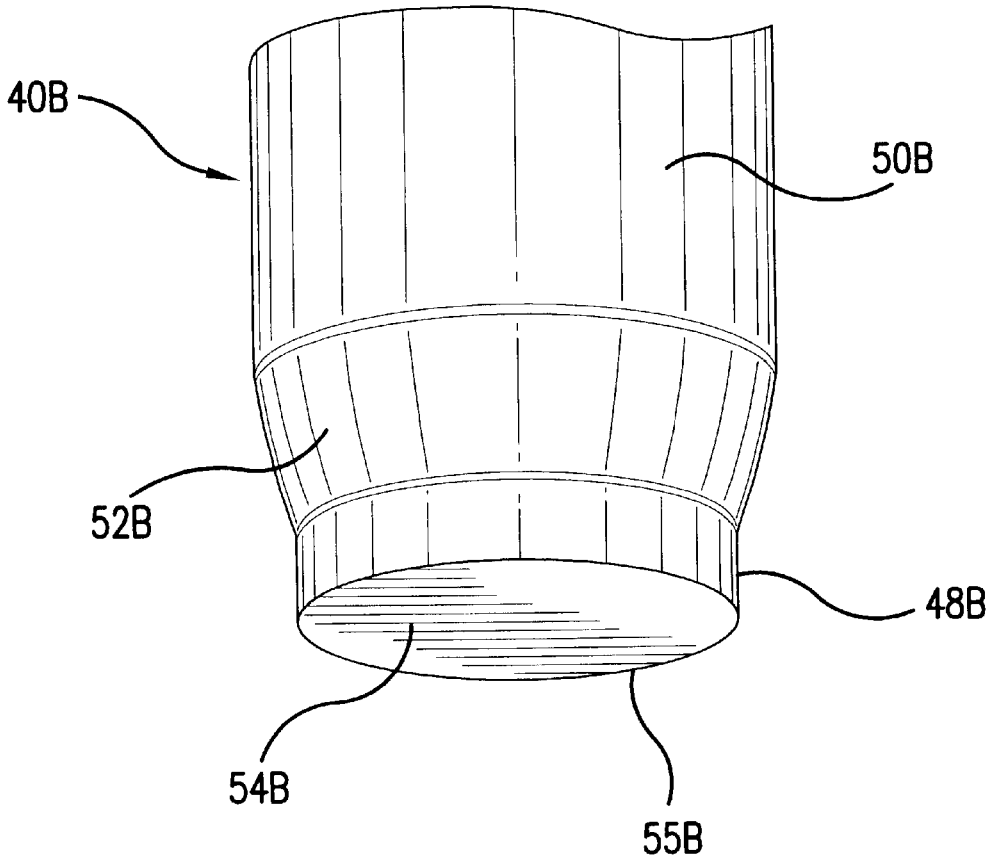
FIG. 12 is a three-dimensional view of the working end of the punch in FIG. 10.

It has also been found that the roll-forming action of the punch can be very smoothly and efficiently accomplished by providing the roll-forming surface of the punch with a convex or rounded surface as shown in the exemplary embodiment of the punch in FIGS. 10–12 wherein the same numbers and the letter "R" used in FIGS. 2–9 are used to identify the punch and corresponding features in FIGS. 10–12 but with the suffix "B" added.

Referring now to FIGS. 10–12, the roll-forming portion of the punch 40B, instead of being formed with an acutely angled surface, is formed about the centerline 47B of punch 40B with a rounded or convex surface 52B between the piercing end portion 48B and the hole-finishing portion 50B. And the portions 48B and 50B have right-circular cylindrical surfaces with respective radiuses R1B and R3B like the portions 48A and 50A of the punch 40A embodiment in FIGS. 7–9. And also like the angled surface 52A on the punch 40A embodiment in FIGS. 7–9, the rounded surface 52B extends completely about the periphery of the punch.

However, it will also be understood that the roll forming portion 52B may as an option extend only partially about the periphery of the punch to a variable degree like the angled surface 52 on the punch 40 embodiment in FIGS. 2–6 and with the piercing end portion 48B also configured accordingly like the partially circular, partially convex surface of the piercing end portion 48 of the punch embodiment in FIGS. 2–6.

The convex shaped roll forming portion 52B is generated by a varying radius R4 or a blend of radiuses and the punch 40B, whether with a partially or fully encircling roll-forming surface and a correspondingly suitably shaped piercing end portion as described above, produces a roll-forming action like the respective punch 40 and punch 40B embodiments as previously described. But in a more smoother manner to form a rolled edge portion about the pierced opening in the part like those previously described and wherein the rolled edge portion either partially or fully encircles the punch as shown in FIGS. 2 and 3 and FIGS. 7 and 8, respectively, and is effective to prevent leakage during the hole forming operation in the hydroforming process. Moreover, it has been found that where some galling of the part may possibly occur with an angled roll-forming surface, the rounded roll-forming surface whether it extends either partially or completely about the punch has been found to not produce galling in a wide variety of hole forming operations because of its smoother roll-forming action.

Having described the above exemplary punches made in accordance with the invention for the purpose of piercing circular or round holes without any accompanying significant leakage, it will be understood that the present invention can also be applied to designing punches for producing holes of various shapes as well as sizes and in convex and concave as well as flat wall regions of the formed part and without incurring leakage past the punch. For example and with respect to the shape of the required hole, the exemplary embodiments of the punches described above have right-circular cylindrical portions with concentric surfaces for producing round holes. But these portions need not be cylindrical and may have other peripheral shapes or profiles to produce an other than circular hole and with the roll forming surface configured accordingly to form a rolled edge portion of sufficient extent in the part to prevent leakage in order to produce the required hole without collapsing the part.

It will thus be understood by those skilled in this art that the punch according to the present invention may take various forms based on the above detailed disclosure and teachings. And therefore it is intended that the invention be limited only by the scope of the appended claims.

What is claimed is:

1. A punch for forming a hole in a hydroformed part in a hydroforming process wherein a hydroforming pressure used to form the part is maintained in the part for the formation of a hole in the part with said punch, said punch comprising a piercing end portion adapted to pierce an opening in the part, a roll-forming portion adapted to enter said opening following said piercing end portion, a hole-finishing portion adapted to fully enter said opening following said roll-forming portion to complete the finishing of a hole required in the part, and said roll-forming portion extending only partially about said punch and having a roll-forming surface adapted on entering said opening to form a rolled edge portion in said part extending only partially about said punch whereby said rolled edge portion forces sealing contact between the part and said punch sufficient to maintain the hydroforming pressure in the part and thereby prevent collapse of the part as said roll-forming portion enters said opening and then when said hole-finishing portion enters said opening to complete the formation of the hole.

2. A punch for forming a hole in a hydroformed part in a hydroforming process wherein a hydroforming pressure used to form the part is maintained in the part for the formation of a hole in the part with said punch, said punch comprising a piercing end portion adapted to pierce an opening in the part, a roll-forming portion extending completely about said punch and adapted to enter said opening following said piercing end portion, a hole-finishing portion adapted to fully enter said opening following said roll-forming portion to complete the finishing of a hole required in the part, and said roll-forming portion having a convex roll-forming surface adapted on entering said opening to form a rolled edge portion in said part extending completely about said punch whereby said rolled edge portion forces sealing contact between the part and said punch sufficient to maintain the hydroforming pressure in the part and thereby prevent collapse of the part as said roll-forming portion enters said opening and then when said hole-finishing portion enters said opening to complete the formation of the hole.

3. A punch for forming a hole in a hydroformed part in a hydroforming process wherein a hydroforming pressure used to form the part is maintained in the part for the formation of a hole in the part with said punch, said punch comprising a piercing end portion adapted to pierce an opening in the part, a roll-forming portion adapted to enter said opening following said piercing end portion, a hole-finishing portion adapted to fully enter said opening following said roll-forming portion to complete the finishing of a hole required in the part, and said roll-forming portion having an acutely angled roll-forming surface extending only partially about said punch and adapted on entering said opening to form a rolled edge portion in said part extending only partially about said punch and the hole being formed whereby said rolled edge portion forces sealing contact between the part and said punch sufficient to maintain the hydroforming pressure in the part and thereby prevent collapse of the part as said roll-forming portion enters said opening and then when said hole-finishing portion enters said opening to complete the formation of the hole.

4. A punch for forming a hole in a hydroformed part in a hydroforming process wherein a hydroforming pressure used to form the part is maintained in the part for the formation of a hole in the part with said punch, said punch comprising a piercing end portion adapted to pierce an opening in the part, a roll-forming portion adapted to enter said opening following said piercing end portion, a hole-finishing portion adapted to fully enter said opening following said roll-forming portion to complete the finishing of a hole required in the part, and said roll-forming portion having a convex roll-forming surface extending only partially about said punch and adapted on entering said opening to form a rolled edge portion in said part extending only partially about said punch and the hole being formed whereby said rolled edge portion forces sealing contact between said part and said punch sufficient to maintain the hydroforming pressure in the part and thereby prevent collapse of the part as said roll-forming portion enters said opening and then when said hole-finishing portion enters said opening to complete the formation of the hole.

5. A punch for forming a hole in a hydroformed part in a hydroforming process wherein a hydroforming pressure used to form the part is maintained in the part for the formation of a hole in the part with said punch, said punch comprising a piercing end portion adapted to pierce an opening in the part, a roll-forming portion adapted to enter said opening following said piercing end portion, a hole-finishing portion adapted to fully enter said opening following said roll-forming portion to complete the finishing of a hole required in the part, and said roll-forming portion having a convex roll-forming surface extending completely about said punch and adapted on entering said opening to form a rolled edge portion in said part extending completely about said punch and the hole being formed whereby said rolled edge portion forces sealing contact between the part and said punch sufficient to maintain the hydroforming pressure in the part and thereby prevent collapse of the part as said roll-forming portion enters said opening and then when said hole-finishing portion enters said opening to complete the formation of the hole.

6. A punch for forming a circular hole in a hydroformed part in a hydroforming process wherein a hydroforming pressure used to form the part is maintained in the part for the formation of a hole in the part with said punch, said punch comprising a piercing end portion adapted to pierce an opening in the part, a roll-forming portion having an acutely angled convex surface extending only partially about said punch and adapted to enter said opening following said piercing end portion, said piercing end portion having a convex surface that extends to said acutely angled convex surface of said roll-forming portion, a hole-finishing portion having a circular cylindrical surface adapted to fully enter said opening following said roll-forming portion to complete the finishing of a hole required in the part, said piercing end portion and said roll-forming portion having a circular cylindrical surface that together form a continuation of said circular cylindrical surface of said hole-finishing portion, and said roll-forming portion adapted on entering said opening to form a rolled edge portion in said part extending only partially about said punch and the hole being formed whereby said rolled edge portion forces sealing contact between the part and said punch sufficient to maintain the hydroforming pressure in the part and thereby prevent collapse of the part as said roll-forming portion enters said opening and then when said hole-finishing portion enters said opening to complete the formation of the hole.

7. A punch for forming a circular hole in a hydroformed part in a hydroforming process wherein a hydroforming pressure used to form the part is maintained in the part for the formation of a hole in the part with said punch, said punch comprising a piercing end portion adapted to pierce an opening in the part, a roll-forming portion having a convex surface extending only partially about said punch and adapted to enter said opening following said piercing end portion, said piercing end portion having a convex surface that extends to said convex surface of said roll-forming portion, a hole-finishing portion having a circular cylindrical surface adapted to fully enter said opening following said roll-forming portion to complete the finishing of a hole required in the part, said piercing end portion and said roll-forming portion having a circular cylindrical surface that together form a continuation of said circular cylindrical surface of said hole-finishing portion, and said roll-forming portion adapted on entering said opening to form a rolled edge portion in said part extending only partially about said punch and the hole being formed whereby said rolled edge portion forces sealing contact between the part and said punch sufficient to maintain the hydroforming pressure in the part and thereby prevent collapse of the part as said roll-forming portion enters said opening and then when said hole-finishing portion enters said opening to complete the formation of the hole.

* * * * *